US005515981A

United States Patent [19]

Gregory et al.

[11] Patent Number: 5,515,981

[45] Date of Patent: May 14, 1996

[54] CLOTHES HANGER ORGANIZER

[76] Inventors: Lisa A. Gregory; William H. Gregory, both of 6 Surrey Dr., Huntington, Conn. 06484

[21] Appl. No.: 225,564

[22] Filed: Apr. 11, 1994

[51] Int. Cl.[6] ..... A47F 5/00

[52] U.S. Cl. ..... 211/113; 211/89

[58] Field of Search ..... 211/89, 90, 106, 211/113, 118, 119; 24/339

[56] References Cited

U.S. PATENT DOCUMENTS

| | | | |
|---|---|---|---|
| D. 190,608 | 6/1961 | Forrester | 211/119 X |
| 1,039,359 | 9/1912 | Brown | 211/119 X |
| 1,899,813 | 7/1931 | Lester | 211/113 X |
| 2,598,614 | 5/1952 | Gilbert | 211/113 |
| 3,003,736 | 10/1961 | Hofgesang | 248/316.7 X |
| 3,887,079 | 6/1975 | Crew | 211/118 |
| 4,034,865 | 7/1977 | Batts et al. | 211/118 |
| 4,058,222 | 11/1977 | Singer | 211/118 |
| 4,709,838 | 12/1987 | Campbell | 211/115 X |

OTHER PUBLICATIONS

The Very Finest Metal Accessories Catalog 1962, rec'd in PTO Sep. 4, 1984. p. 8.

*Primary Examiner*—Robert W. Gibson, Jr.
*Attorney, Agent, or Firm*—John H. Crozier

[57] ABSTRACT

In a preferred embodiment, an organizer for empty clothes hangers, the organizer comprising: a generally planar panel; apparatus to support the panel from an elevated member; a plurality of vertically spaced apart suspension apparatus disposed along at least one side of the panel; and the suspension apparatus being so sized and spaced apart that at least one empty clothes hanger can be suspended from each suspension apparatus by the insertion of the hooks of the clothes hangers in the suspension apparatus, without two or more of the empty clothes hangers so suspended becoming entangled.

5 Claims, 2 Drawing Sheets

CLOTHES HANGER ORGANIZER

BACKGROUND OF THE INVENTION

1. Field of the Invention

The present invention relates to clothes hangers generally and, more particularly, but not by way of limitation, to a novel organizer for clothes hangers.

2. Background Art

In most residences, closet space is limited or, at least, most always seems to be limited. One reason for the limited space is the need to have on hand a supply of empty clothes hangers for future use. The empty hangers, typically, are simply stored side by side on a horizontal clothes hanging rod in a closet. This creates less usable closet space and causes unnecessary creases on the clothes hanging in the closet which are being squeezed together on the rod by the space consumed by the empty hangers. As well as creating space inefficiency, the unused hangers are prone to becoming entangled.

Sometimes, in order to avoid the foregoing problems, unused hangers are stored in bags or boxes. This helps solve the problem of rod space, but still requires considerable (usually closet) space to store the bags or boxes. Furthermore, once the hangers are placed in this type of storage container, they immediately become entangled. If one is looking for a particular hanger or type of hanger, it is necessary to sort through and untangle all the hangers to find the one sought.

Accordingly, it is a principal object of the present invention to provide an organizer for empty clothes hangers.

It is a further object of the invention to provide such an organizer which keeps hangers from becoming entangled and which consumes little horizontal space in a closet.

It is an additional object of the invention to provide such an organizer that is simple and economical to construct.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, an organizer for empty clothes hangers, said organizer comprising: a generally planar panel; means to support said panel from an elevated member; a plurality of vertically spaced apart suspension means disposed along at least one side of said panel; and said suspension means being so sized and spaced apart that at least one said empty clothes hanger can be suspended from each said suspension means by the insertion of the hooks of said clothes hangers in said suspension means, without two or more of said empty clothes hangers so suspended becoming entangled.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
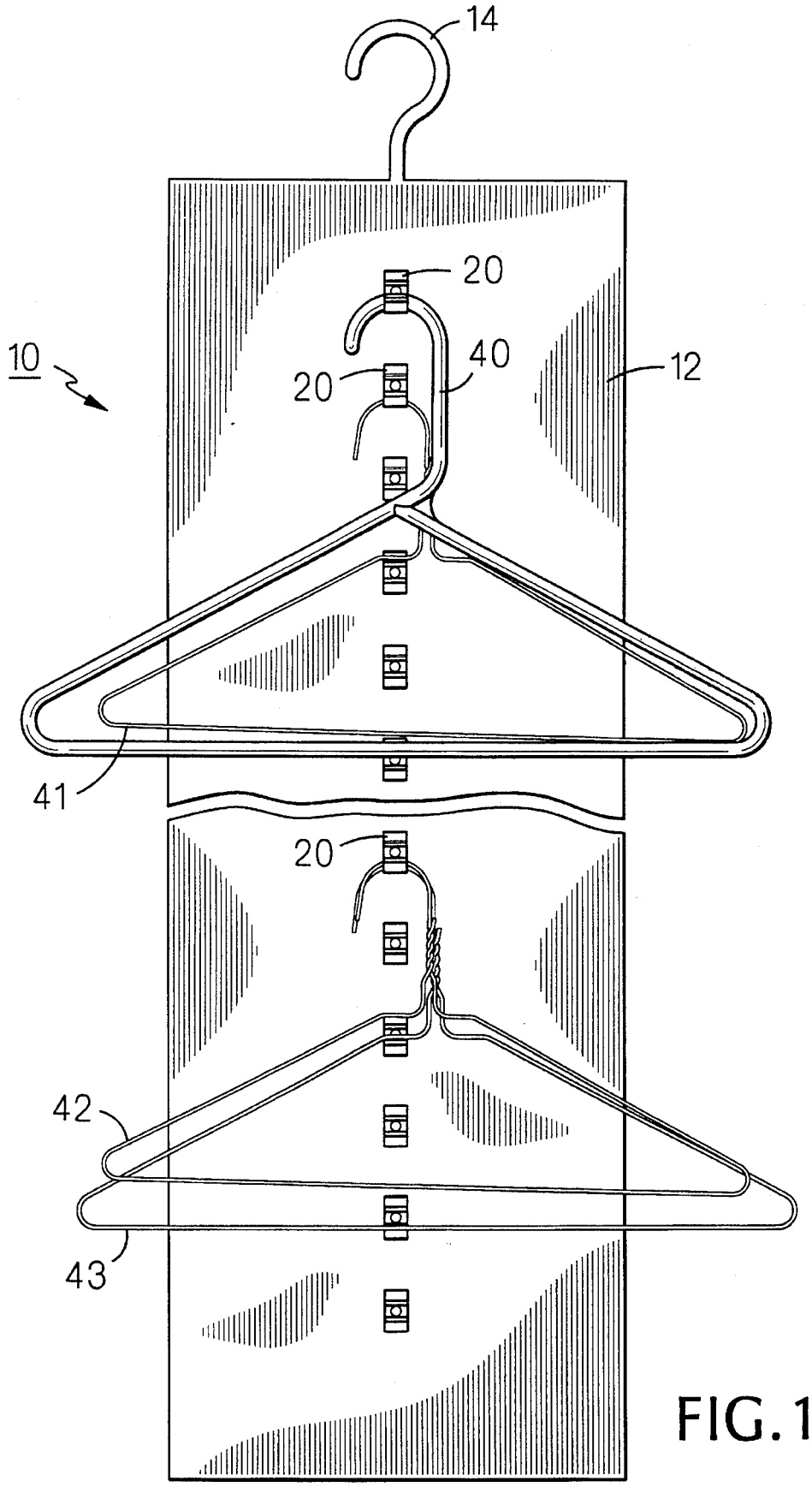
FIG. 1 is a fragmentary, front elevational view of an organizer for empty clothes hangers, with hangers thereon.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Figure 2:
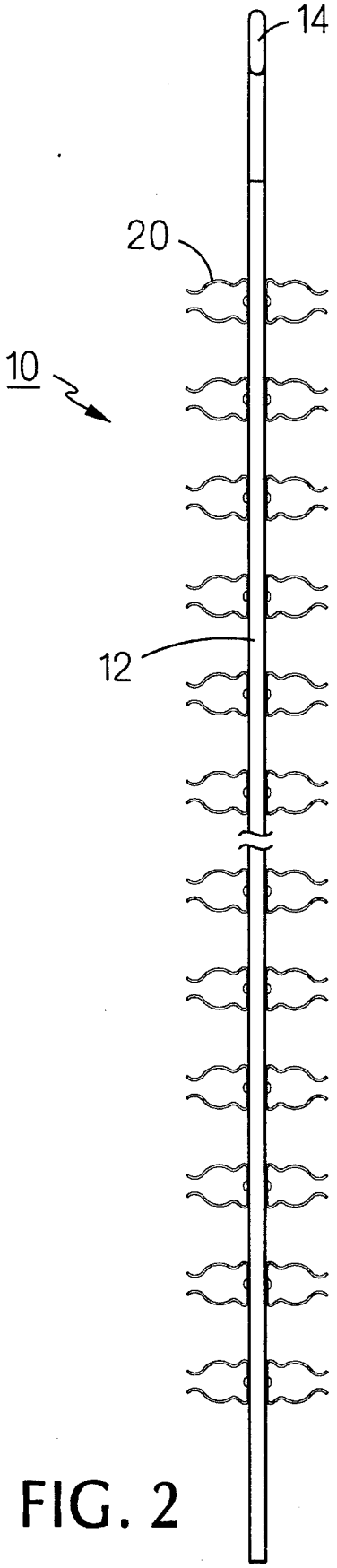
FIG. 2 is a fragmentary side elevational view of the organizer, without hangers.

Referring to FIGS. 1 and 2 together, there is illustrated an organizer for empty clothes hangers constructed according to the present invention, generally indicated by the reference numeral 10. Organizer 10 includes a generally planar frame or panel 12 being somewhat elongated in the vertical direction. Generally centered at the top of panel 12 is a hook 14 for hanging organizer 10 from a standard clothes rod (not shown) in a closet. Attached to at least one side of panel 12 are a plurality of spring clips, as at 20, the spring clips being vertically aligned along the major axis of the panel.

Figure 3:
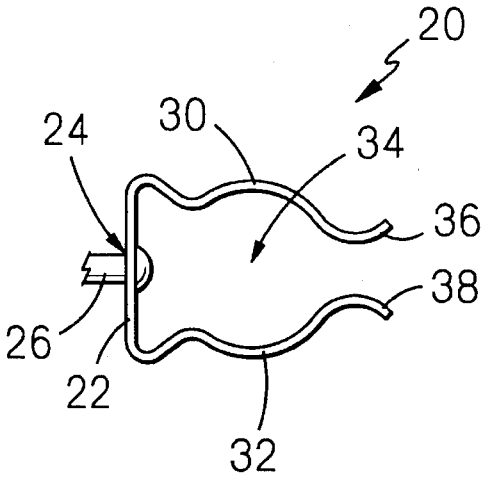
FIG. 3 is a side elevational view of a spring clip for use in the present invention.

Referring to FIG. 3, each spring clip 20 comprises a bent metal or molded plastic form which includes a straight vertical portion 22 having a hole 24 defined therethrough to accept therein fastening means such as a rivet 26 to secure the spring clip to panel 12 (FIG. 2). Alternatively, spring clips 20, panel 12, and hook 14 may be formed together as a single part, for example, by injection molding of a suitable plastic material. Extending generally horizontally outwardly from the upper and lower ends of vertical portion 22 are upper and lower leaves 30 and 32, the leaves having oppositely extending concave portions formed medially therein so as to create a central enlarged horizontal opening 34 therebetween. Distal ends 36 and 38 of upper and lower leaves 30 and 32 are bent somewhat towards each other to provide an openable closure for central opening 34.

Referring also again to FIG. 2, spring clips 20 are so sized and spaced apart on panel 12 such that, for example, empty clothes hangers 40, 41, 42, and 43 may have their hooks thrust between distal ends 36 and 38 (FIG. 3) of the spring clips into central openings 34 to lie against lower leaves 32 and thereby be supported by organizer 10.

Depending on the user's preference, one or more hangers may be hung from one spring clip 20 or one spring clip may be used for each hanger. In any case, spring clips 20 hold the hangers snugly in place so that they cannot easily fall off organizer 10. Hangers can be placed in any desired order and any one can be removed without removing one from an adjacent spring clip 20. For example, heavy plastic hanger 40 is suspended from one spring clip 20, while a wire hanger 41 is suspended from another spring clip 20 immediately below. It can be seen that wire hanger 41 can be removed by reaching under hanger 40 without having to remove the latter hanger. Hangers 42 and 43 are shown has being suspended from a single spring clip 20. Any desired number of spring clips 20 may be provided, limited only by the vertical length of panel 12.

Panel 12 may be economically constructed from a suitable wood, plastic, or metal material. The width of panel 12 should be at least about one-third the width of the largest hanger to be suspended thereon to prevent entangling of the hangers, particularly when spring clips 20 are disposed on both sides of the panel.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. An organizer for empty clothes hangers, said organizer comprising:

(a) a generally planar panel, said panel having a width, in a direction parallel to said empty clothes hangers, at least about one-third the width of the largest of said empty clothes hangers to be suspended therefrom such as to prevent the tangling of said empty clothes hangers;

(b) means to support said panel from an elevated member;

(c) a plurality of vertically spaced apart suspension means disposed along at least one side of said panel; and (d) said suspension means being so sized and spaced apart that at least one said empty clothes hanger can be suspended from each said suspension means by the removable insertion of hooks of said clothes hangers in said suspension means, without two or more of said empty clothes hangers so suspended becoming entangled.

2. An organizer for empty clothes hangers, as defined in claim 1, wherein said suspension means are aligned along a vertical major axis of said panel.

3. An organizer for empty clothes hangers, as defined in claim 1, wherein said each of said suspension means comprises a spring clip.

4. An organizer for empty clothes hangers, as defined in claim 3, wherein said spring clip comprises:

(a) a straight vertical portion fastenable to said panel to secure said spring clip to said panel;

(b) upper and lower leaves having proximal ends attached to upper and lower ends of said vertical portion and extending generally horizontally outwardly therefrom, said leaves having oppositely extending concave portions formed medially therein so as to create a horizontal, central, enlarged opening therebetween; and (c) distal ends of said upper and lower leaves being bent somewhat towards each other to provide an openable closure for said central opening.

5. An organizer for empty clothes hangers, as defined in claim 1, wherein said panel and said suspension means are of one-piece construction.

* * * * *